US010188172B1

(12) United States Patent
Wurtz

(10) Patent No.: US 10,188,172 B1
(45) Date of Patent: Jan. 29, 2019

(54) MASSAGE INSOLE WITH MULTIPLE SUPPORT REGIONS

(71) Applicant: Health Shoes Plus, Inc., Largo, FL (US)

(72) Inventor: Jacob Wurtz, Largo, FL (US)

(73) Assignee: Health Shoes Plus, Inc., Largo, FL (US)

( * ) Notice: Subject to any disclaimer, the term of this patent is extended or adjusted under 35 U.S.C. 154(b) by 0 days.

(21) Appl. No.: 15/961,300

(22) Filed: Apr. 24, 2018

Related U.S. Application Data

(63) Continuation-in-part of application No. 29/623,223, filed on Oct. 24, 2017, now Pat. No. Des. 819,307, and a continuation-in-part of application No. 29/623,224, filed on Oct. 24, 2017, now Pat. No. Des. 819,317.

(51) Int. Cl.

| | |
|---|---|
| ***A43B 7/14*** | (2006.01) |
| ***A43B 7/32*** | (2006.01) |
| ***A43B 17/02*** | (2006.01) |
| ***A43B 17/14*** | (2006.01) |
| ***A43B 1/10*** | (2006.01) |

(52) U.S. Cl.
CPC ..... *A43B 7/1475* (2013.01); *A43B 1/10* (2013.01); *A43B 7/141* (2013.01); *A43B 7/142* (2013.01); *A43B 7/143* (2013.01); *A43B 7/144* (2013.01); *A43B 7/146* (2013.01); *A43B 7/1425* (2013.01); *A43B 7/32* (2013.01); *A43B 17/023* (2013.01); *A43B 17/14* (2013.01)

(58) Field of Classification Search
CPC ..... A43B 7/141; A43B 7/142; A43B 7/1425; A43B 7/144; A43B 7/146; A43B 17/023; A43B 3/108
USPC ..... 36/141
See application file for complete search history.

(56) References Cited

U.S. PATENT DOCUMENTS

| | | | | |
|---|---|---|---|---|
| 2,696,057 A * | 12/1954 | Flautt | A43B 3/128 36/11.5 |
| 3,589,037 A | 6/1971 | Gallagher | |
| 3,722,113 A * | 3/1973 | Birkenstock | A43B 7/141 36/11.5 |
| 3,757,774 A * | 9/1973 | Hatuno | A43B 3/128 36/141 |

(Continued)

FOREIGN PATENT DOCUMENTS

| | | |
|---|---|---|
| JP | S5946901 A | 7/1982 |
| WO | 2008068871 | 6/2008 |

OTHER PUBLICATIONS

Images of Trademark registration No. 3362452 for KENKOH filed on Jan. 12, 2006—see attached.

*Primary Examiner* — Ted Kavanaugh
(74) *Attorney, Agent, or Firm* — Larson & Larson, P.A.; Justin P. Miller; Frank Liebenow

(57) ABSTRACT

The insole described within uses a multiplicity of nodules of varying diameters and heights to provide the requisite level of flexibility, support, and stimulation to the various regions of the foot. These advantages are created while maintaining a low thickness, thereby allowing the insole to fit within a shoe without creating discomfort.

Gradients of pressure that generate variations in the laminar flow of the foot bed lead to better circulation and perfusion of the capillary foot bed of the foot transection irrigation, allowing for better circulation and venous return.

9 Claims, 8 Drawing Sheets

(56) References Cited

U.S. PATENT DOCUMENTS 3,885,555 A * 5/1975 Nobbs ..... A43B 7/146 601/28
D250,738 S 1/1979 Foldes
D251,216 S 3/1979 Krippelz
4,345,387 A * 8/1982 Daswick ..... A43B 7/146 36/29
D278,571 S 4/1985 Eber
4,541,184 A * 9/1985 Leighton ..... A43B 7/144 36/178
D281,735 S 12/1985 Seltzer
4,627,179 A * 12/1986 McElroy ..... A43B 17/14 36/154
D292,441 S 10/1987 Gamm
D305,954 S * 2/1990 Kin ..... D2/961
5,035,068 A * 7/1991 Biasi ..... A43B 1/0045 36/141
5,068,983 A * 12/1991 Marc ..... A43B 7/142 36/43
D373,013 S * 8/1996 Rosetta ..... D2/961
D376,895 S 12/1996 Cook
5,860,229 A * 1/1999 Morgenstern ..... A43B 7/1415 36/141
5,930,916 A 8/1999 Connor
5,992,055 A 11/1999 Connor
6,675,501 B2 1/2004 Pfander
7,703,219 B2 * 4/2010 Beck ..... A43B 17/08 36/147
D641,142 S * 7/2011 Lindseth ..... D2/916
D738,082 S * 9/2015 Ho ..... D2/961
9,192,205 B2 * 11/2015 McDowell ..... A43B 3/108
9,254,591 B2 2/2016 Fox
2008/0022561 A1 * 1/2008 Klavano ..... A43B 7/146 36/141
2016/0183627 A1 * 6/2016 Ho ..... A43B 7/146 36/3 B
2016/0353840 A1 * 12/2016 Mason ..... A43B 17/08

* cited by examiner

MASSAGE INSOLE WITH MULTIPLE SUPPORT REGIONS

CROSS-REFERENCE TO RELATED APPLICATIONS

This application is a continuation in part of U.S. design patent application Ser. No. 29/623,223 filed Oct. 24, 2017, titled Massage Sandal and U.S. design patent application Ser. No. 29/623,224 filed Oct. 24, 2017, titled Massage Insole.

FIELD

This invention relates to the field of shoes and more particularly to an insole that fits within a shoe, providing arch support and massage by way of protruding nodules.

BACKGROUND

The human foot is an incredible biological machine. It is strong enough to support the repeated impacts of running and the constant pressure of standing. But it remains dexterous enough to balance on a tightrope or pick up a marble from the floor.

Feet manage these disparate tasks using a collection of bones and muscles. Only when these bones and muscles are functioning properly can the foot fully perform. In order to properly function, the bones and muscles must be maintained in the optimal positions.

In addition to maintaining position, the feet must also be stimulated. As the lowest point in the body, there is a tendency for blood to settle in the feet and lower legs. This blood pooling causes swelling and reduces the local oxygen concentration, thereby increasing the time required to heal wounds.

Stimulation of the feet pushes blood out of the foot, and thereby out of the lower legs. The stimulation has the added benefit of activating the reflexology zones of the feet, thereby causing therapeutic improvement throughout the body.

Shoes are often designed and assembled with form placed before function. As a result, shoes often fail to provide the support and stimulation desired.

Thus, what is needed is an insole that can be placed inside a shoe, helping the shoe to support the bones and muscles of the foot, while simultaneously providing stimulation in the form of varying pressure.

SUMMARY

The disclosed insole, uses nodules of varying diameters and heights to provide the requisite level of flexibility, support, and stimulation to the specific regions of the foot.

Gradients of pressure that generate variations in the laminar flow of the foot bed lead to better circulation and perfusion of the capillary foot bed of the foot transection irrigation, allowing for better circulation and venous return.

Before turning to the invention, an understanding of the foot is helpful.

The human foot is formed from twenty-six bones, grouped into the tarsal bones, metatarsal bones, and phalanges. The bones are shaped to form three arches within the foot—the medial longitudinal arch, the lateral longitudinal arch, and the transverse arch. The longitudinal arches run from the front region of the foot to the back region of the foot, while the transverse arch runs from side to side.

The medial longitudinal arch and the lateral longitudinal arch are formed between the tarsal bones and the proximal end of the metatarsals.

The medial longitudinal arch is the highest of the two longitudinal arches. It runs along the inside of the foot, along its length. When one says he has a "high arch," or a "low arch," it is typically this arch being referenced.

The lateral longitudinal arch is the flatter of the two longitudinal arches. It runs along the outside of the foot, also along its length. The lateral longitudinal arch collapses when the body is in the standing position, and thus is less commonly known.

The transverse arch is just behind the ball of the foot, running from side to side.

Proper support of a foot requires supporting the medial longitudinal arch, transverse arch, and the lateral longitudinal arch.

In disclosed insoles, support for the arches comes from nodules of varying diameter and height.

Varying the nodules height alters the depth to which each nodule penetrates the bottom of the foot, and thus its ability to create a massaging action. As a related effect, taller nodules flex more from side-to-side than shorter nodules. This flexion is also affected by the diameter of the nodule. A nodule of greater diameter resists flexion, and thus has a greater tendency to resist bending.

No single nodule creates the desired massage effect, but rather the combination of many nodules. While the user walks, applying pressure to the back, middle, then front of the foot, the many nodules work together to create waves of pressure. These waves of pressure massage the bottoms of the feet and foster circulation.

This pressure wave effect is enhanced through the use of flexible nodules that focus the pressure on individual points of the sole of the foot.

The massaging action acts on the nerves, blood vessels, muscles, and connective tissue of the foot. As recognized by the field of reflexology, the application of pressure to the feet can create positive physical changes to areas of the body beyond the feet. For example, the area of the foot referred to as the ball is associated with the treatment of lung disorders.

The result of the supportive nature of the midsole and nodule combination, in conjunction with the massaging action, is that the disclosed insole can treat a multiplicity of foot conditions. For example, plantar fasciitis. Plantar fasciitis a common cause of heel pain. The pain is caused by inflammation of a thick band of tissue that runs across the bottom of the foot, connecting the heel bone to the toes.

The supportive and massaging action of the disclosed insoles acts to treat the inflamed tissue, while supporting the foot to encourage healing.

Turning to the support structure of the insole: the insole includes a wedge-shaped insole wedge beneath a portion of the foot bed. The insole wedge provides additional shock absorption for the rear of the foot. The insole wedge is preferably formed from a shock absorbing material, such as a foam rubber. In contrast, the foot bed is a less compressible material, such as a natural latex rubber, artificial rubber, or a combination thereof.

Turning to the arch support created by the insole:

The transverse arch support is a rectangular support region centered on what, during use, is just behind the ball of the foot.

The lateral longitudinal arch support is an arc along the outside of the foot. The support in this region is created by the use of the insole wedge in combination with short nodules. The short nodules resist bending, and thus create a support effect at the expense of a lessening massage effect. To use longer nodules may create the feeling of a sideways-shifting foot during a step, akin to walking on a slippery surface. This is an undesirable effect, and thus avoided by using shorter nodules in areas of the insole where stability is desired.

The medial longitudinal arch support is formed from a trapezoidal section of tall, wide nodules, combined with the insole wedge, thus creating a higher food bed. The height of the nodules results in deep tissue pressure, massaging the arch. Their thickness acts to reduce side to side motion, partially compensating for the nodule height.

This arch is where the most support is needed to avoid flattening. Without proper support the foot can turn inwards, which affects the ankle joint, the knee, the hip, and so forth.

Other regions of the insole are load bearing, rather than providing arch support. These load bearing regions include nodules, but of a lesser height than non-load bearing, thus avoiding lateral motion between the foot and the shoe.

The disclosed device is an insole for placement within a shoe. As a result, there are certain structural limitations. For example, increasing the height of the foot within a shoe can create discomfort, in particular compression of the toes and arch at the front of a shoe. Thus, certain regions of the insole use short nodules in order to limit the insole thickness, and thus lessen the amount the foot is raised within the shoe.

For example, the toe contact region is in the front of the insole. Relatively short nodules, with a diameter approximately equal to their height, are used to minimize bending and allow the toes to stabilize the foot.

The ball contact region is a critical load bearing section of the insole. It is a section of smaller, consistently-sized nodules that provide support between the toe arch support and the transverse arch.

The load passed through the heel of the foot is critical to stability. The insole uses a heel cup that lacks nodules to provide the most support without the risk of lateral shifting.

The heel cup is surrounded by short nodules that are higher than the heel cup itself. Thus, there is a self-centering action that maintains the heel within the heel cup.

The total quantity of nodules varies slightly among shoe sizes, but is around 1,390-1,400 total nodules. Reasonable deviation above and below this range is anticipated, and will not affect the function of the shoe or its therapeutic benefits.

The upper sole that includes the nodules is formed from a combination of a foot bed and nodules. The nodules protrude from the foot bed.

The nodules discussed above are complemented by a partial insole wedge. The partial insole wedge is substantially tapered, starting toward the front of the medial longitudinal arch support and increasing in thickness toward the back of the insole.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
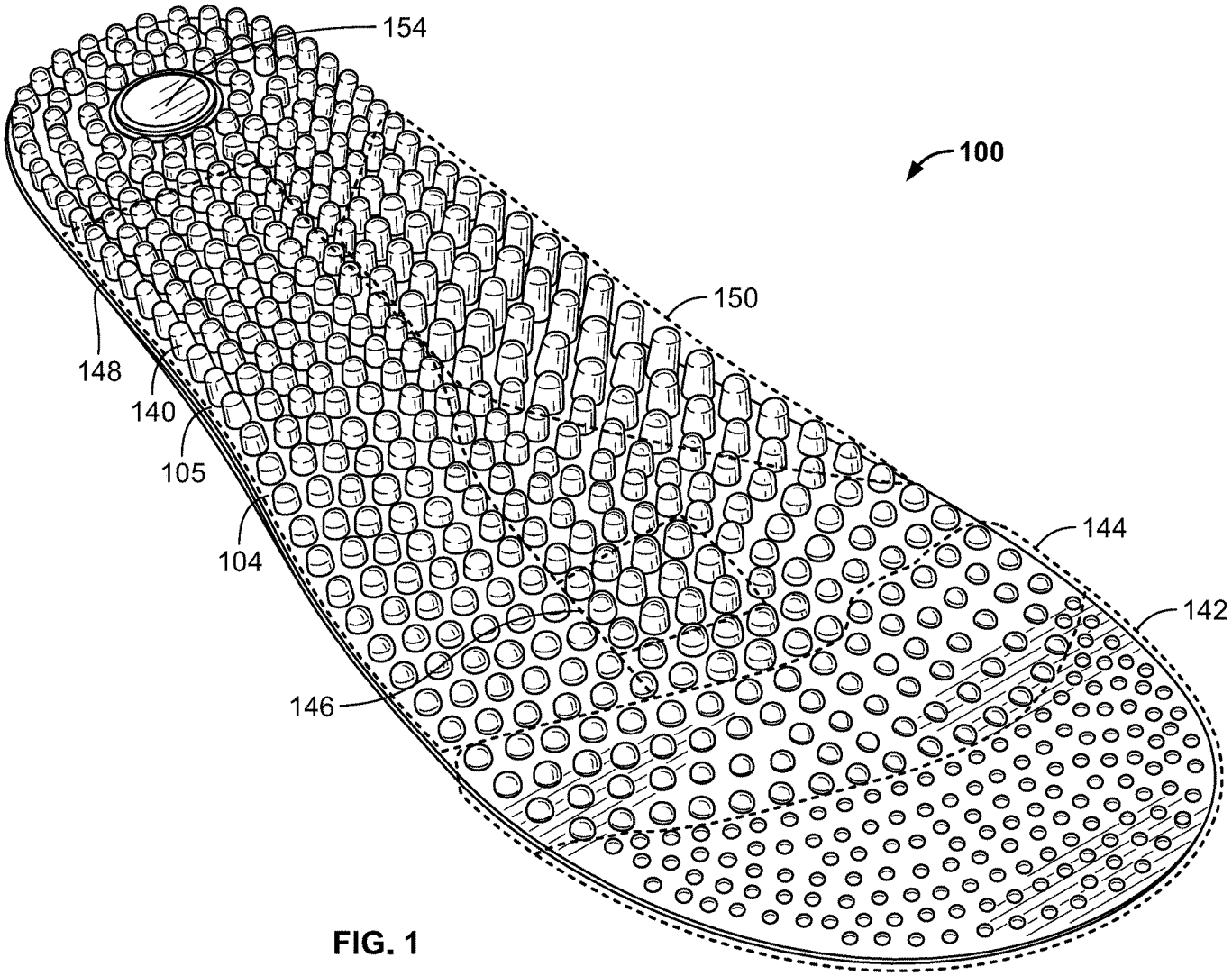
FIG. 1 is a perspective view of a first embodiment of the disclosed insole.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a first embodiment of the disclosed insole is shown.

The insole 100 includes an upper sole 104 formed from a combination of a foot bed 105 and nodules 140.

Nodules 140 of differing heights and widths form differing support regions within the insole 100. A toe contact region 142 includes nodules 140 of minimal height to minimize the height increase of the foot 1 (see FIG. 8) within the shoe. The ball contact region 144 includes nodules 140 of increased width and height to provide a greater massaging action to the ball 10 (see FIG. 8) of the foot 1 (see FIG. 8).

Figure 8:
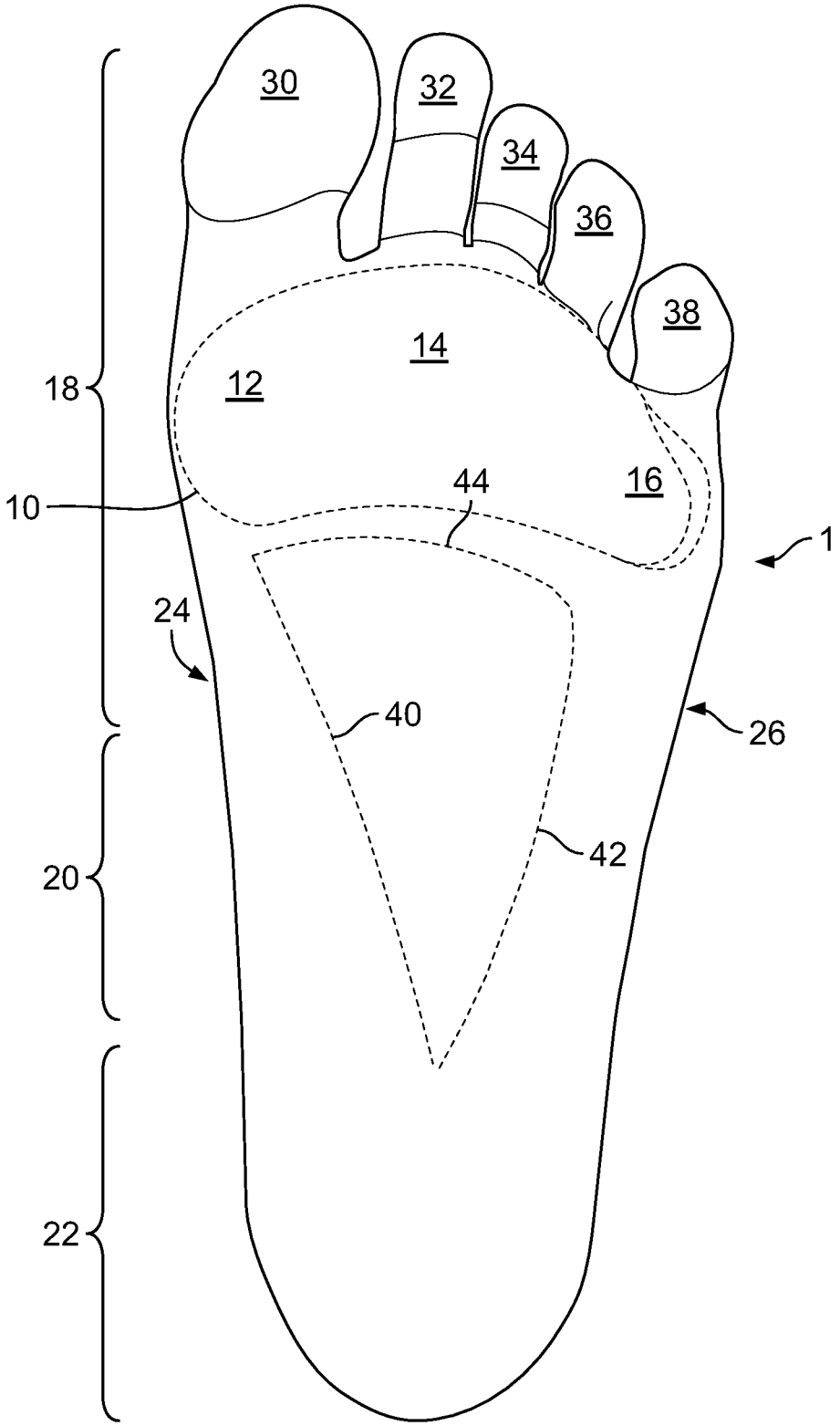
FIG. 8 is a view of the bottom of an exemplary human foot.

The transverse arch support 146 is a region of increased nodule 140 height as compared to surrounding regions, thereby providing support for the transverse arch 44 (see FIG. 8) of the foot 1 (see FIG. 8). The transverse arch support 146 is formed from a number of nodules arranged in a grid. For example, the use of between ten and forty nodules to form the transverse arch support 146 is anticipated.

Lateral longitudinal arch support 148 uses smaller nodules, but increasing in height toward the rear of the insole 100. The increased height maximizes the benefit of the nodules, and biasing toward the rear of the insole 100 avoids greatly increasing the height of the foot 1 (see FIG. 8) within the shoe.

The most significant arch support, the medial longitudinal arch support 150, is shown with a trapezoidal shape. The nodules 140 increase in height and diameter moving from the center of the insole 100 toward the edge of the inner foot 24 (see FIG. 8).

The heel cup 154 is shown with its associated nodules 140 that surround a section without nodules 140. The result is firm support for the heel 22 (see FIG. 8) with minimal lateral shifting.

Figure 2:
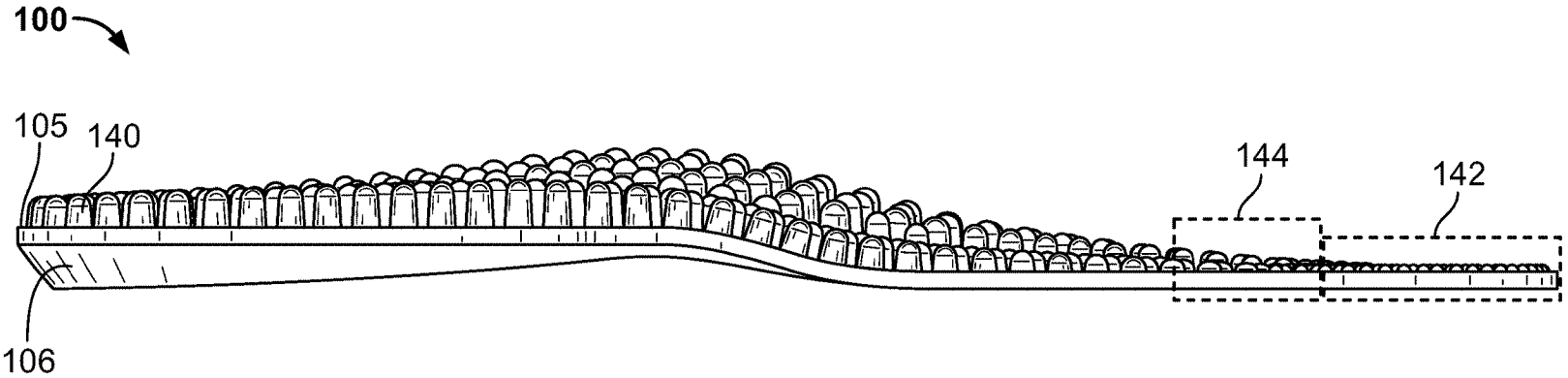
FIG. 2 is a right-side view thereof.

Referring to FIG. 2, a right-side view of a first embodiment of the insole 100 is shown.

The insole 100 is shown with foot bed 105 and a multiplicity of nodules 140. The partial insole wedge 106 decreases in thickness from the rear of the insole 100 toward the middle of the insole 100.

The short nodules 140 of the toe contact region 142 are shown, as are the slightly higher nodules 140 of the ball contact region 144.

Figure 3:
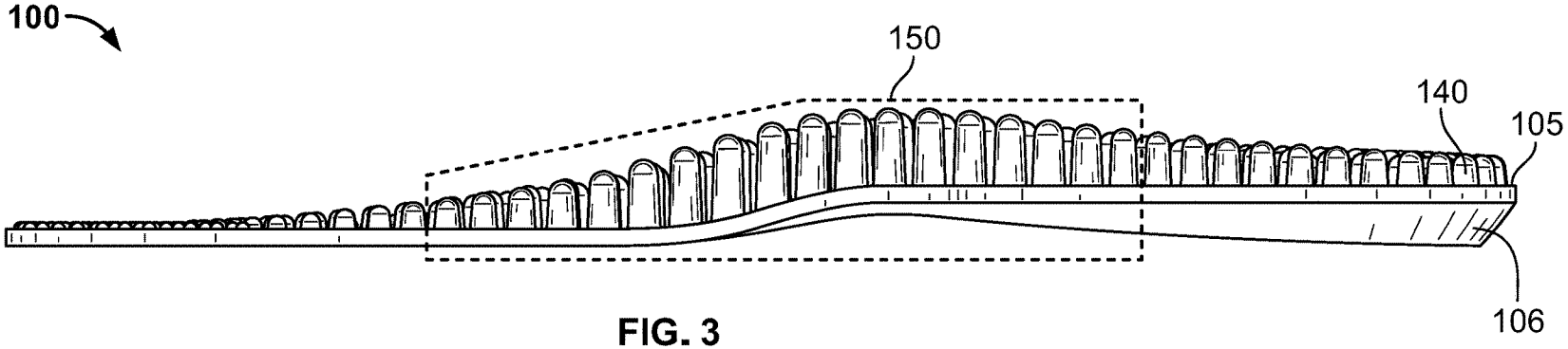
FIG. 3 is a left-side view thereof.

Referring to FIG. 3, a left-side view of a first embodiment of the insole is shown.

The medial longitudinal arch support 150 is shown with the higher, wider nodules 140. Again, the partial insole wedge 106 is shown decreasing in thickness from the rear of the insole 100 toward the middle of the insole 100.

Figure 4:
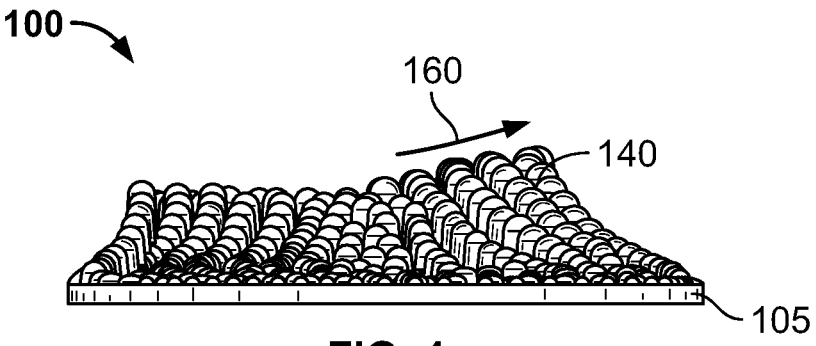
FIG. 4 is a front view thereof.
Figure 5:
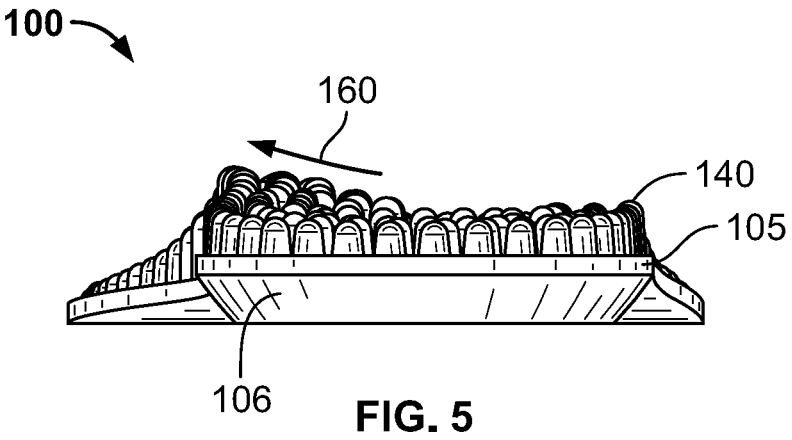
FIG. 5 is a back view thereof.

Referring to FIG. 4, a back view of a first embodiment of the insole 100 is shown, and FIG. 5, a front view of a first embodiment of the insole 100 is shown.

The nodules 140 are shown increasing in height toward the inside of the insole 100, forming a lateral longitudinal arch support slope 160.

The increased height forms the medial longitudinal arch support 150 (see FIG. 1).

Figure 6:
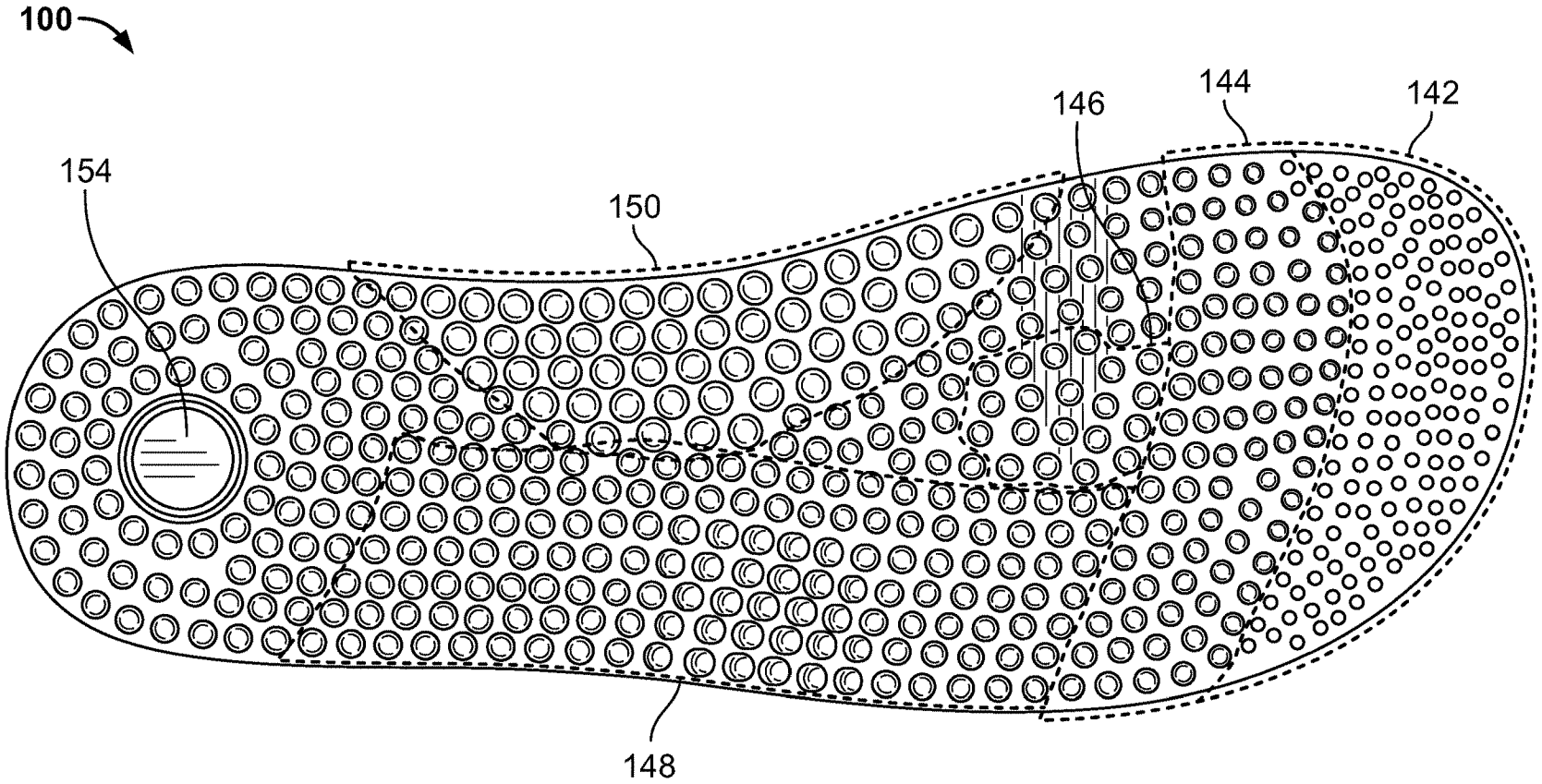
FIG. 6 is a top view thereof.

Referring to FIG. 6, a top view of a first embodiment of the insole 100 is shown.

Again shown are the toe contact region 142, ball contact region 144, transverse arch support 146, lateral longitudinal arch support 148, medial longitudinal arch support 150, and heel cup 154.

Figure 7:
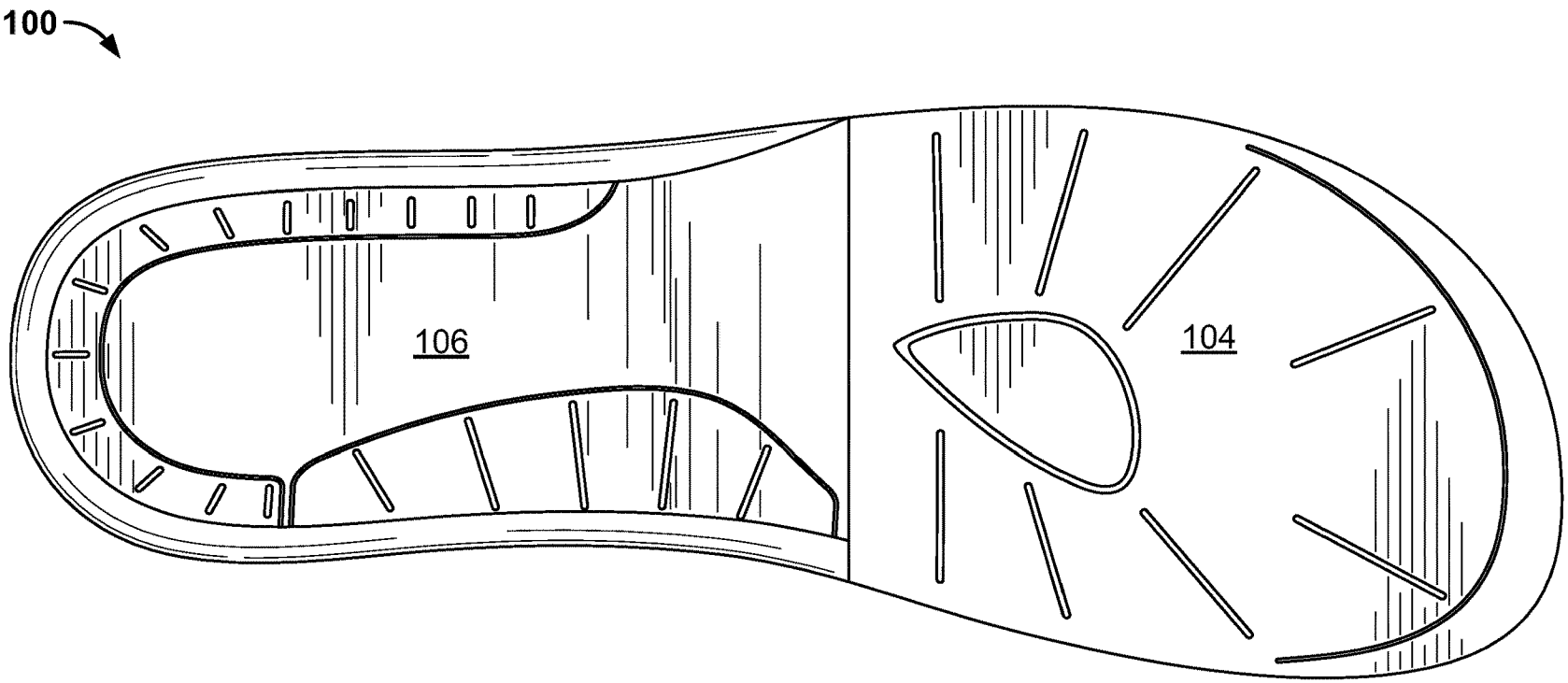
FIG. 7 is a bottom view thereof.

Referring to FIG. 7, a bottom view of a first embodiment of the insole 100 is shown.

The partial insole wedge 106 passes from the rear of the insole 100 to slightly past the middle of the insole 100. Where not covered by the partial insole wedge 106, the upper sole 104 is seen from the bottom view.

Referring to FIG. 8, a view of the bottom of an exemplary human foot is shown.

The foot 1 is generally divided into the forefoot 18, midfoot 20, and heel 22. Within the forefoot 18, the foot 1 includes the ball 10, or region behind the toes. The ball 10 is divided into the inner ball 12, middle ball 14, and outer ball 16.

The portion of the foot 1 that faces toward its matching foot is referred to as the inner foot 24. Its opposite is the outer foot 26.

The toes include the hallux or big toe 30, second toe or index toe 32, third toe or middle toe 34, fourth toe or ring toe 36, and fifth toe or little toe 38.

The arches of the foot 1 include the medial longitudinal arch 40, lateral longitudinal arch 42, and transverse arch 44.

Figure 9:
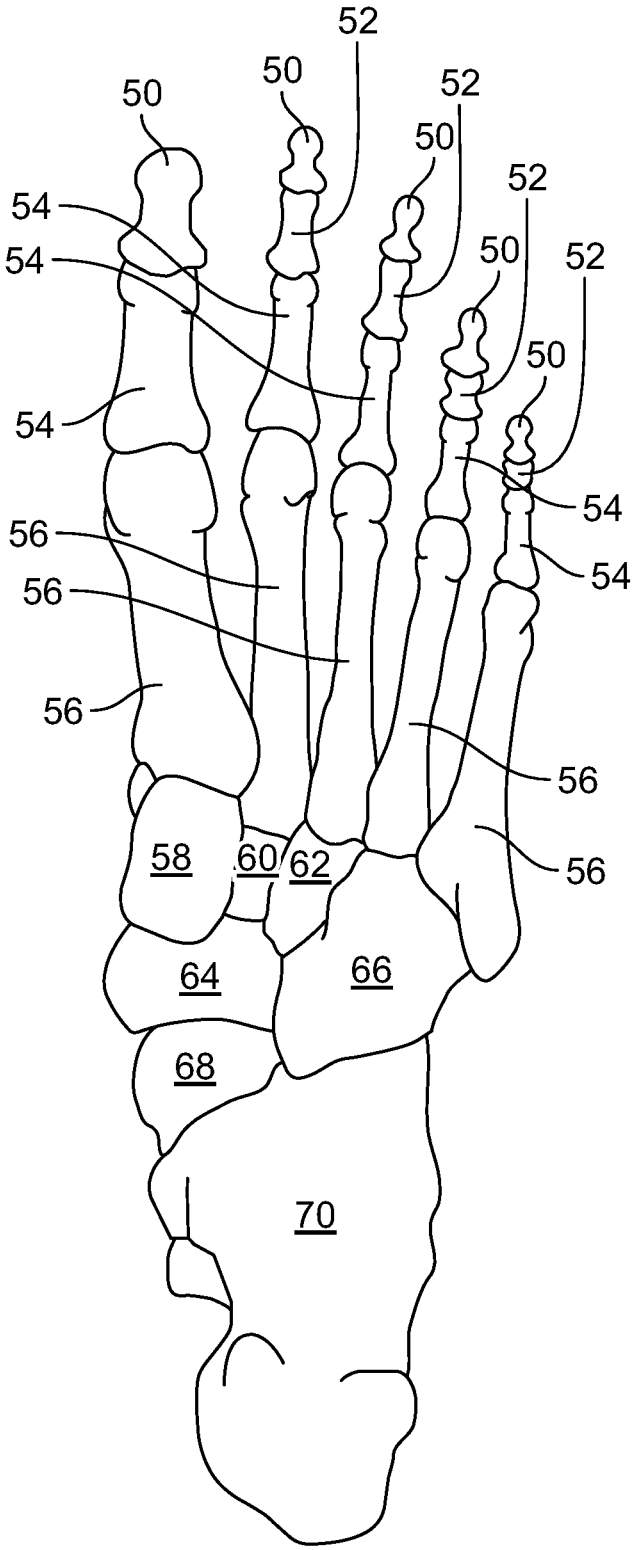
FIG. 9 is a view of the bones within an exemplary human foot.

Referring to FIG. 9, a view of the bones within an exemplary human foot is shown.

The distal phalanges 50, middle phalanges 52, proximal phalanges 54, and metatarsals 56 make up the forefoot 18 (see FIG. 8).

The medial cuneiform 58, middle cuneiform 60, lateral cuneiform 62, navicular 64, and cuboid 66 make up the midfoot 20.

Finally, the talus 68 and calcaneus 70 make up the heel 22.

Figure 10:
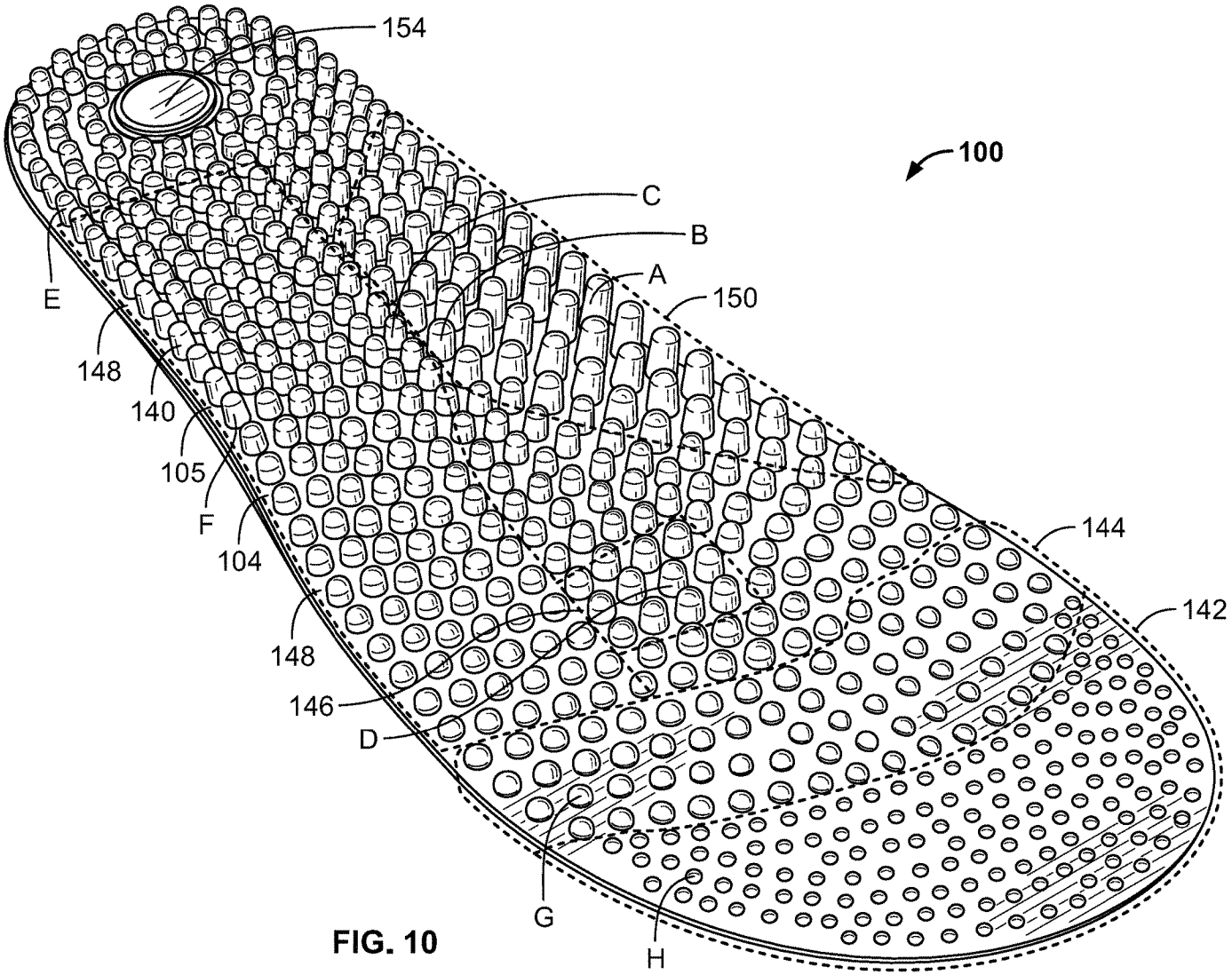
FIG. 10 is a view of the insole with exemplary nodule height and width measurements.

Referring to FIG. 10, a view of the insole 100 with exemplary nodule 140 height and width measurements.

For each letter location, measurements were taken. All measurements are in millimeter (mm), with the exception of the dimensionless ratio.

The measurements are as follows:

Min Dia (mm)—the minimum nodule 140 diameter, taken at or near the top of the nodule 140;

Max Dia (mm)—the maximum nodule 140 diameter, taken at or near the bottom of the nodule 140;

Height (mm)—the nodule 140 height, measured from the top of the foot bed 105;

Foot bed thickness (mm)—the thickness of the underlying foot bed 105;

Wedge thickness (mm)—the thickness of the partial insole wedge 106, if it exists beneath the measured section of foot bed 105; and Ratio of nodule 140 max dia to height—the ratio of maximum nodule 140 diameter over nodule 140 height.

| Nodule | Min dia (mm) | Max dia (mm) | Height (mm) | Foot bed thick-ness (mm) | Wedge thick-ness (mm) | Ratio of nodule max dia to height | Nodule region |
|---|---|---|---|---|---|---|---|
| A | 4.3 | 5.7 | 12.0 | 2.4 | 1.0 | 0.5 | medial longitudinal arch support |
| B | 4.5 | 5.0 | 6.4 | 2.4 | 1.5 | 0.8 | medial longitudinal arch support |
| C | 3.5 | 3.9 | 5.0 | 2.4 | 1.5 | 0.8 | lateral longitudinal arch support |
| D | 3.6 | 4.6 | 5.5 | 2.3 | N/A | 0.8 | transverse arch support |
| E | 3.7 | 4.1 | 5.6 | 2.3 | 5.7 | 0.7 | lateral longitudinal arch support* |
| F | 3.6 | 4.0 | 5.5 | 2.4 | 2.0 | 0.7 | lateral longitudinal arch support |
| G | 3.2 | 3.4 | 1.1 | 1.1 | N/A | 3.1 | ball contact region |
| H | 2.0 | 2.0 | 1.0 | 1.0 | N/A | 2.0 | toe contact region |

*Nodule located just to the rear of this region.

Measurements A, B, and C support the assertion of taller nodules 140 in the medial longitudinal arch support 150, with decreasing height toward the center of the insole 100, reflecting the lateral longitudinal arch support slope 160.

Measurements G and H show the use of shorter nodules 140 toward the front of the insole 100.

The ratio of nodule 140 diameter to height shows how stiffer nodules 140 are used in areas of greater support. For example, the ratio for measurement A is lower than that of F, indicating a taller or narrower nodule 140, and thus more prone to flexion. This is acceptable as measurement A was taken in the medial longitudinal arch support 150 region where the more flexible nodule 140 maximizes the massage effect, and measurement F was taken in transverse arch support 146 region, where the stiffer nodule 140 focuses on support.

Measurements G and H show very stiff nodules 140, indicating little flexion with a strong focus on support.

It is noted that the foot bed 105 is a substantially equal thickness across the insole 100.

Equivalent elements can be substituted for the ones set forth above such that they perform in substantially the same manner in substantially the same way for achieving substantially the same results.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An insole for use on a human foot, the human foot including a medial longitudinal arch, a lateral longitudinal arch, a transverse arch, and toes, the insole comprising:

a foot bed of substantially consistent thickness;

the foot bed being flexible to permit insertion into a shoe;

a multiplicity of nodules affixed to the foot bed, the multiplicity of nodules of varying heights, the varying heights taken as an average to define an average nodule height;

a transverse arch support adapted to support the transverse arch;

the transverse arch support created by nodules having a greater than average height;

lateral longitudinal arch support;

the lateral longitudinal arch support created by nodules having a lesser than average height;

medial longitudinal arch support;

the medial longitudinal arch support created by nodules having a greater than average height;

a partial insole wedge beneath a portion of the foot bed;

the partial insole wedge formed from a material with greater shock absorption than that of the foot bed;

the partial insole wedge having a tapered shape from thin to thick, being thin at a center of the insole and thick at a back of the insole;

the insole for placement into a shoe;

whereby the nodule height determines the amount of support provided to the human foot.

2. The insole of claim 1, further comprising:

a heel cup adapted to support a heel of the human foot;

the heel cup including a foot bed region without nodules in order provide support without lateral movement.

3. The insole of claim 1, wherein the transverse arch support is formed from a grid of between ten and forty nodules.

4. The insole of claim 1, further comprising:

a toe support region adapted to support toes of the human foot;

the toe support region formed by nodules lesser than average height, and of substantially equal height and width.

5. The insole of claim 1, further comprising:

a ball support region adapted to support the ball of the human foot;

the ball support region formed by nodules lesser than average height, and of substantially equal height and width.

6. An insole that provides both support and therapeutic massaging to a human foot, the human foot including a medial longitudinal arch, a lateral longitudinal arch, a transverse arch, and toes, the insole comprising:

a foot bed;

the foot bed having a thickness;

the thickness being substantially consistent throughout the insole;

a multiplicity of nodules;

each nodule of the multiplicity of nodules affixed to the foot bed;

each nodule of the multiplicity of nodules having a height and a diameter;

a partial insole wedge;

the partial insole wedge joined to the foot bed;

the partial insole wedge formed from a material with greater shock absorption than that of the foot bed;

the partial insole wedge having a thick end and a thin end;

the thick end toward a rear of the insole;

the thin end toward a middle of the insole;

the insole divided into regions that are adapted to support the human foot, the regions including:

a toe contact region, adapted to massage the toes, the associated nodules being a minimum height;

a transverse arch support region, adapted to correspond to the transverse arch, the associated nodules being taller than surrounding nodules;

a lateral longitudinal arch support region, adapted to correspond to the lateral longitudinal arch, wherein the associated nodules are no taller than the surrounding nodules;

a medial longitudinal arch support region, adapted to correspond to the medial longitudinal arch, wherein the associated nodules are of a greater height and greater diameter;

the insole for insertion into a shoe;

whereby the nodules act to support the medial longitudinal arch, lateral longitudinal arch, and transverse arch, while providing a massaging action during walking.

7. The insole of claim 6, further comprising:

a heel cup adapted to support a heel of the human foot;

the heel cup including a foot bed region without nodules to provide support without lateral movement.

8. The insole of claim 6, wherein the transverse arch support is formed from a grid of between ten and forty nodules.

9. The insole of claim 6, further comprising:

a ball support region adapted to support the ball of the human foot;

the ball support region formed by nodules lesser than average height, and of substantially equal height and width.

* * * * *